United States Patent [19]

Ferguson

[11] Patent Number: 4,625,971

[45] Date of Patent: Dec. 2, 1986

[54] CROSSWORD PUZZLE EDUCATIONAL GAME

[76] Inventor: Jack A. Ferguson, 5818 Glenndale Rd., Glenndale, Md. 20769

[21] Appl. No.: 644,967

[22] Filed: Aug. 28, 1984

[51] Int. Cl.[4] ..... A63F 3/00

[52] U.S. Cl. ..... 273/272; 273/283

[58] Field of Search ..... 273/272, 273, 283, 284, 273/282 R; 434/177

[56] References Cited

U.S. PATENT DOCUMENTS

| | | | |
|---|---|---|---|
| 2,055,159 | 9/1936 | Scofield | 273/272 |
| 3,799,549 | 3/1974 | Laker | 273/282 X |
| 3,840,236 | 10/1974 | Beskrone | 273/272 |
| 3,877,703 | 4/1975 | Pierre | 273/272 X |
| 4,244,580 | 1/1981 | Hoyles | 273/272 |

FOREIGN PATENT DOCUMENTS

| | | | |
|---|---|---|---|
| 868040 | 9/1941 | France | 273/282 |
| 1128269 | 9/1968 | United Kingdom | 273/272 |

*Primary Examiner*—Harland S. Skogquist
*Attorney, Agent, or Firm*—Leonard Bloom

[57] ABSTRACT

An educational game requiring skills in both language and scoring ability involving correlating certain zones on a playing surface with scoring opportunities. A game board is formed from moldable material having first and second marginal borders provided with a plurality of pockets adapted to receive therewithin letter tiles having diverse colors on opposed sides correlatable to letters of the alphabet printed as indicia on the game board itself. Inwardly disposed therefrom is a four-sided frame having pairs of spaced opposed parallel vertical and horizontal legs defining a rectangular frame provided with numerical and alphabetical correlatives oriented to assist in deployment of a plurality of segments within the frame. Immediately within the frame itself a plurality of segments formed by N×N arrays define a peripheral playing surface within which a central major playing segment is disposed having a 3N×3N array. Orientation of all of the segments provides varied and diverse games since indicia are provided on each of the segments in the form of darkened squares, crosses, diamonds, and lightened squares of two colors allowing different scoring opportunities.

20 Claims, 25 Drawing Figures

2 LETTERS
AX
BE

3 LETTERS
BEE
EFT
EWE
MEN
RAT
WOK
YAK

4 LETTERS
ANAT
AUKS
BOAR
CAWS
CROW
COLT
DEER
EMUS
IBEX
NEWT
ORCA
RUBE
SAKI
SORA
TITI
TUNA
WASP
WREN
ZEBU

5 LETTERS
DINGO
HONEY
ORANG
OTTER
PUMAS
SHARK
SHREW
TAPIR
ZEBRA

6 LETTERS
ALEVIN
IMPALA

7 LETTERS
MANATEE
HABITAT

8 LETTERS
GORILLAS
PIRANHAS

9 LETTERS
REDBREAST

2 LETTERS

AX
BE

3 LETTERS

BEE
EFT
EWE
MEN
RAT
WOK
YAK

4 LETTERS

ANAT
AUKS
BOAR
CAWS
CROW
COLT
DEER
EMUS
IBEX
NEWT
ORCA
RUBE
SAKI
SORA
TITI
TUNA
WASP
WREN
ZEBU

5 LETTERS

DINGO
HONEY
ORANG
OTTER
PUMAS
SHARK
SHARK
SHREW
TAPIR
ZEBRA

6 LETTERS

ALEVIN
IMPALA

7 LETTERS

MANATEE
HABITAT

8 LETTERS

GORILLAS
PIRANHAS

9 LETTERS

REDBREAST

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| A | D | E | E | R | | O | R | A | N | G | | E | M | U | S |
| B | I | | | A | | R | | U | | O | | | A | | O |
| C | N | E | W | T | | C | | K | | R | | | N | | R |
| D | G | | | | C | A | W | S | | I | M | P | A | L | A |
| E | O | T | T | E | R | | | | | L | | | T | | |
| F | | | | W | O | K | | C | O | L | T | | E | F | T |
| G | S | H | R | E | W | | R | | | A | | B | E | | U |
| H | A | | E | | | P | U | M | A | S | | E | | | N |
| I | K | | D | | | I | B | E | X | | Z | E | B | R | A |
| J | I | | B | | W | R | E | N | | | E | | | | |
| K | | | R | | | A | | | H | A | B | I | T | A | T |
| L | A | L | E | V | I | N | | | | | U | | | | A |
| M | N | | A | | | H | O | N | E | Y | | W | A | S | P |
| N | A | | S | | | A | | | | A | | E | | | I |
| O | T | I | T | I | | S | H | A | R | K | | B | O | A | R |

PATTERN 3

Fig. 8

CROSSWORD PUZZLE EDUCATIONAL GAME

BACKGROUND OF THE INVENTION

This invention relates generally to educational games which are simulative of crossword puzzles and includes a scoring method associated with the game.

More particularly, the instant invention relates to a game board provided with a means for storing a plurality of tiles each having a letter of the alphabet disposed thereon, a game playing area framed by a peripheral border, a recessed central area and a plurality of raised lips intermediate the peripheral border to serve as constraints within which removeable segments of the game board are to be inserted. The segments include a relatively large central segment and a plurality of smaller equally dimensioned segments surrounding the central larger segment, each of which are adapted to be oriented in a plurality of ways. The central segment can be oriented in eight different ways as can the marginal segments. The marginal segments can also be interchanged around the periphery of the central segment, vastly increasing the number of possible configurations for the game.

Various attempts have been noted in the prior art which purport to answer the longstanding yet heretofore unfulfilled need for a game board simulative of a crossword puzzle which is both challenging and not susceptible to predictability and therefor more closely relies on the skill of the players rather than one person having become familiarized with the specific game.

The following citations reflect the state of the art of which applicant is aware, insofar as these patents appear germane to the process at hand: U.S. Pat. Nos. 4,131,282, Boyer et al, Dec. 26, 1978; 4,171,815, Sturtz, Oct. 23, 1979; 4,205,852, Wayman, Jun. 3, 1980; 4,244,580, Hoyles, Jan. 13, 1981; 4,299,578, Wayman, Nov. 10, 1981, 4,341,386, Kleva, July 27, 1982.

Sturtz teaches the use of a word forming game including the game board having three peripheral closed sides and a fourth open side adapted to receive a template defining a crossword puzzle. The template apparently denotes voids or areas not to be filled in during the course of the game.

Kleva provides a game board apparatus in which a central cruciform shaped member is adapted to have attached thereto, four game board sections each of which are placed between the conjunction of two legs forming the cross.

The patent to Hoyles provides a board game apparatus in which gridded playing areas can be removeably placed within a central game board, each of the gridded playing areas of equal dimension and adapted to be oriented such as in FIG. 3 to provide a crossword puzzle type game.

Each patent to Wayman provides a crossword system and game apparatus particularly adapted to create crossword puzzles which appears to require a knowledge of statistics for generating words into the grid and making possibility checks from a table of average preference values when assigning constant and vowel locations based on frequency rate in conjunction with word blanks.

The instant invention is patently distinguished over the known prior art even though some of these patents share a coincidental structural similarity with certain aspects of the instant invention. For example, while Boyer et al is concerned with providing a more difficult game of tic-tac-toe, applicant's invention relates more properly to crossword puzzle games which already have a requisite skill threshold that neither needs difficulty enhancement nor requires the complex methodology of Boyer et al. The instant invention is distinguished over the templates of Sturtz in that a greater flexibility is provided by the playing board of applicant which is formed from a plurality of segments of equal dimensions surrounding a central segment of greater dimension. Thus, the central segment can be oriented in any of eight possible ways as can the peripheral segments, but the peripheral segments can also be oriented in any of the recessed areas surrounding the central area for further game variety. While Kleva provides a game board apparatus having removeable playing surfaces, the means for attaching the playing surfaces is, by construction, constrained to a central segment having radiating arms which serve to support the removable playing surfaces. Applicant's invention has a plurality of upstanding lips on the playing surface within which the segments are adapted to be nested requiring a less cumbersome and costly segment orientation means and further allows greater flexibility in the deployment of the segments. Applicant's invention is further distinguished over Hoyles in that Hoyles requires a magnetic means for selecting playing pieces in a random manner and is further devoid of structural elements unique to applicant's invention upon which successful and enjoyable play is predicated. The two remaining citations diverge even further from applicant's invention.

More particularly, applicant provides an instrumentality for orienting a plurality of segments (in the preferred embodiment, 16 segments) around a central larger segment. The central larger segment can be manipulated in eight different ways (by having either side of the central segment face up, and rotating the segment so that one of four edges is on top). The marginal segments can similarly be manipulated and also can be placed in any of the sixteen recessed areas thereby defining an extremely large number of possible playing configurations. In addition, each of the segments is provided with indicia thereon denoting areas upon which letter tiles are to be placed, areas upon which letter tiles are not to be placed, and special scoring indicia to encourage word formation along selected lines including color coding. The surface which supports the peripheral and central segments includes a marginal border having a means for storage of playing tiles so that utilization of the tiles can be evidenced in a facile manner. Each of the segments is segregated from an adjacent segment by means of a lip defining areas of abutment between adjacent segments. The underside of the playing board can include a lazy susan type support so that a plurality of players can re-orient the board to face each player during one's appropriate turn. A scoring system is provided to enhance the objects of the game as will be explained hereinafter.

OBJECTS AND SUMMARY OF THE INVENTION

Accordingly, this invention has as its objective the provision of a new and novel educational crossword puzzle game.

It is yet a further object of this invention to provide a device as characterized above which lends itself to reorientation in a plurality of ways so that a large number of playing configurations will have been evidenced.

It is yet a further object of this invention to provide a game as characterized above which defines premium scoring areas characterized by indicia disposed on playing segments to provide incentive for players to fill certain areas of the playing surface in preference to other areas.

It is yet a further object of this invention to provide a device as characterized above which is relatively inexpensive to manufacture, lending itself to mass production techniques and is durable in construction.

It is yet a further object of this invention to provide a device as characterized above which is readily understable and lends itself to play by people of all ages and skill levels.

These and other objects will be made manifest when considering the following detailed specification when taken in conjunction with the appended drawing figures wherein there has been provided a game board having an area provided with upstanding lips adapted to define intervening depressions within which a plurality of marginal segments of equal dimension are deployed to circumscribe and define a central depression which receives a central segment having greater relative magnitude. In addition, marginal portions of the playing board include pockets within which letter tiles are adapted to be disposed for storage and retrival purposes during the play of the game. In a preferred form of the invention, a lazy susan type swivel is disposed on the underside of the game board to facilitate the orientation of the board for a series of players, and indicia are provided on the segments which when oriented in any of a plurality of ways define different scoring opportunities to encourage deployment of letter tiles in selected areas for acclerated scoring purposes.

BRIEF DESCRIPTION OF THE DRAWINGS

FIG. 8 illustrates the completed puzzle.

BRIEF DESCRIPTION OF THE PREFERRED EMBODIMENT

Figure 1:
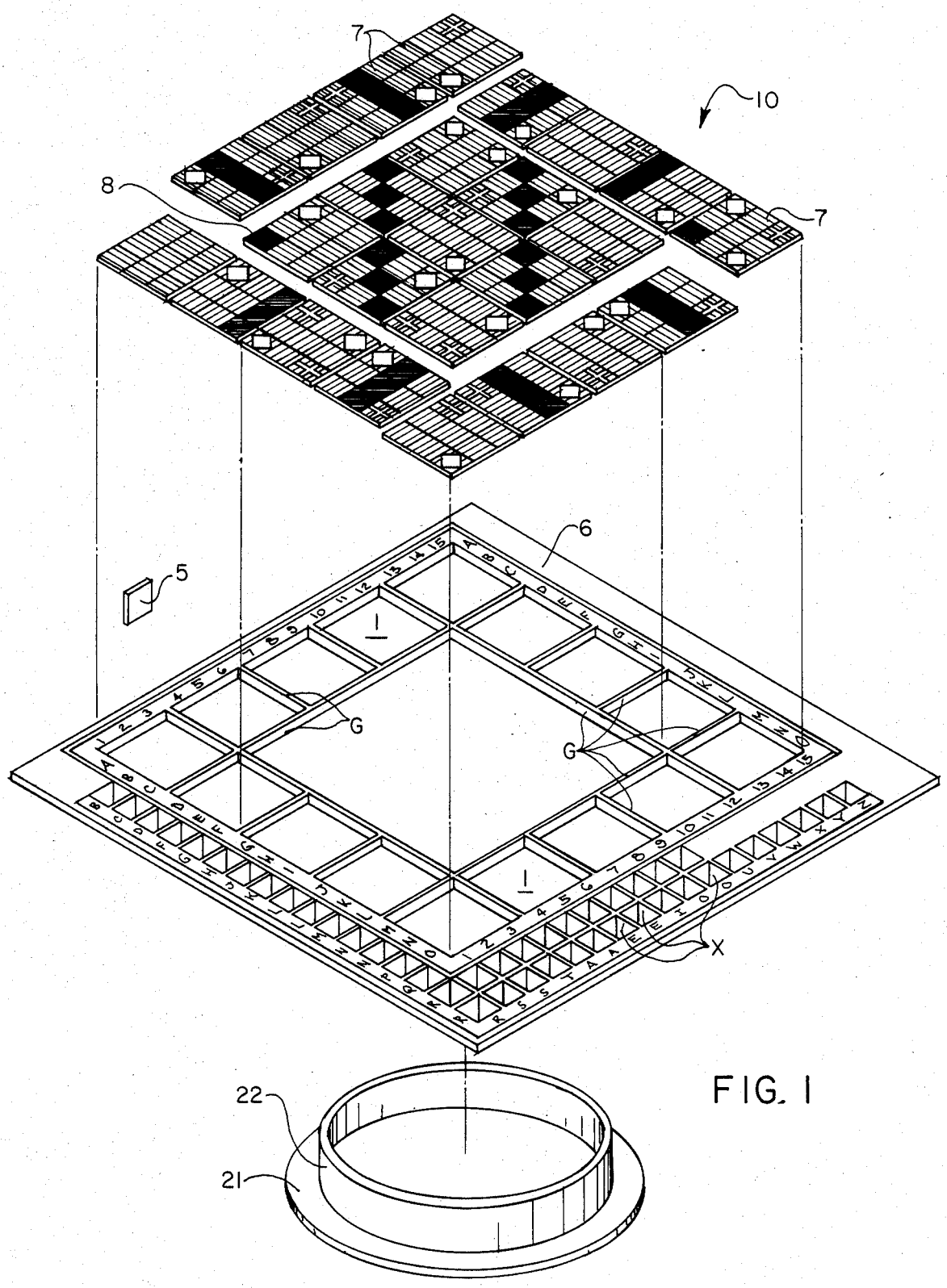
FIG. 1 is an exploded parts perspective view of the game board according to the present invention.
Figure 6:
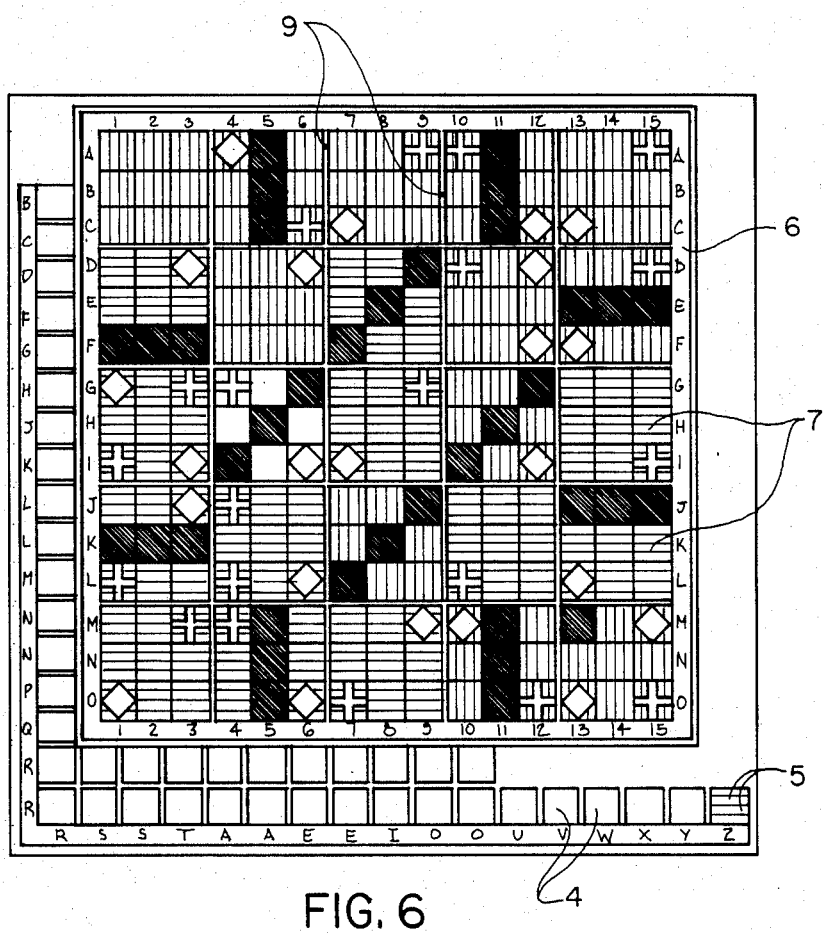
FIG. 6 is a top plan view.
Figure 2A:
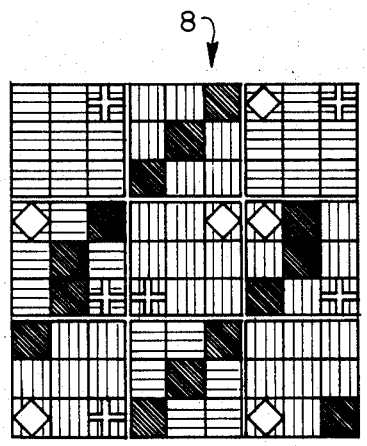
FIG. 2A*a*–J*j* are front and rear views of the plurality of segments defining the variable playing surface.
Figure 2A:
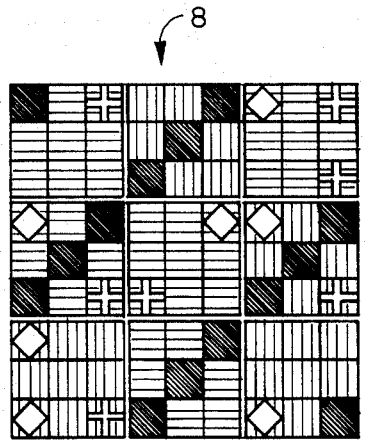
Figure 2B:
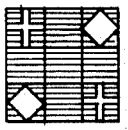
Figure 2C:
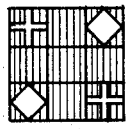
Figure 2E:
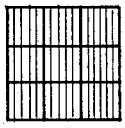
Figure 2F:
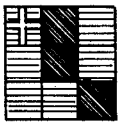
Figure 2G:
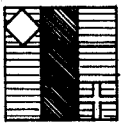
Figure 2B:
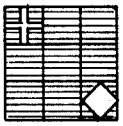
Figure 2C:
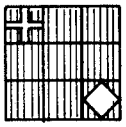
Figure 2E:
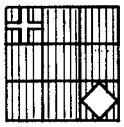
Figure 2F:
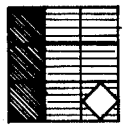
Figure 2G:
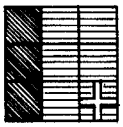
Figure 2H:
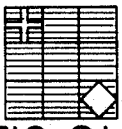
Figure 2I:
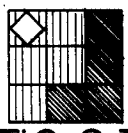
Figure 2J:
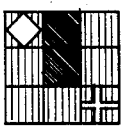
Figure 2H:
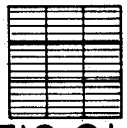
Figure 2I:
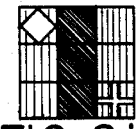
Figure 2J:
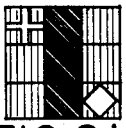

Referring to the drawings now, wherein like reference numerals refer to like parts throughout the various drawing figures, reference numeral 10 is directed to the game board apparatus referred to as PATCHWORD$_{tm}$ and PATCHCROSS$_{tm}$.

As shown in the drawing figures, the game board apparatus includes an upper playing surface 1, a lower surface 2 upon which a lazy susan type swivel 3 depends so that the board may be rotated about a central vertical axis of the board whereby various players can rotate the board and have the board address them full face.

When looking at the game board from a top plan view thereof, the lower and left hand marginal portions of the top playing surface 1 include a plurality of pockets 4 running along the border thereof, the pockets formed from a single trough having partitions therewithin and indicia adjacent each pocket thus formed corresponding to all of the letters of the alphabet whereby letter tiles 5 correlating to the alphabet are placed within the pockets for facile retrieval and deployment during the course of the game. Opposite faces of each tile are red and blue respectively.

In a preferred form of the invention, each of the pockets 4 are adapted to receive a plurality of letter tiles 5 therewithin, a preferred number being six such tiles. As can be seen from the board, letters occurring with greater frequency in the formation of words are also more prevalent in the game tiles. Thus, two such pockets have been reserved for the letter "N" thereby providing twelve such tiles, and commonly found letters such as "A", "E", "O", etc. are prevalent by occupying four such pockets thereby providing twenty-four such letters. The preferred configuration shown in the drawing figures however is not to be construed as a limitation. Inboard of the marginal edge of the game board apparatus, a frame 6 is provided which is of substantially rectangular configuration and circumscribes the playing area. First and second spaced parallel horizontally disposed legs of the frame contain a plurality of numbers which as shown in the drawing figures runs from one to fifteen, while vertical spaced parallel legs interconnecting the horizontal legs thereby defining the frame have letters of the alphabet running from "A" to "O" thereon. The purpose of this second form of indicia will be made manifest in the ensuing description.

Inboard of the frame 6 the playing surface is defined accommodating a plurality of segments 7. More particularly, a plurality of segments 7 abut the legs of the frame 6 and are hereafter defined as marginal segments circumscribe the playing surface and define a peripheral area inboard of which a central segment 8 is adapted to be received. As is shown in the drawing figures, each marginal segment 7 defines a $3\times3$ array so that when disposed within the frame 6, each marginal segment occupies three numerals and three letters of the alphabet on the frame. In the given example, the horizontal and vertical legs of the frame define a $15\times15$ array, accordingly sixteen marginal segments are deployed. The central most portion of the game board is therefor fashioned to accommodate a larger central segment 8 having the dimensions of a $9\times9$ array.

In a preferred form of the invention, adjacent segments are constrained from motion and allowed to be oriented within their respective area of disposition by means of a plurality of lips 9 raised from the upper surface 1 of the game board 10. These lips 9 run to the peripheral frame which defines the boundary of the playing surface. Thus, a rectangular lip is formed adapted to constrain and confine the central segment 8, and as shown as an example, two pairs of four lips each respectively extend horizontally and vertically respectively to provide the partitions for the marginal segments 7.

In a preferred form of the invention, the game board itself is formed from a molded plastic so that the pockets, lips and peripheral frame can all be formed in one molding operation. FIG. 1 evidences the bottom surface of the game board as including a lazy susan swivel having a disc shaped outer surface adapted to reside on a supporting surface, an annular wall extending upwardly therefrom, and a puck shaped bearing member depending from the bottom surface 2 of the game board and nested within the upwardly extending annular wall of the disc. A bearing surface between the puck and the annular wall is provided with means for easy rotation of the board about 360°.

FIG. 2 depicts the front and rear of all segments used in a preferred form of the invention. Preferably these segments are made from cardboard or plastic and are appropriately color coded to enhance the visual appearance of the board and to provide scoring opportunities not normally available with a single color. As shown in the drawings, both the central and marginal segments are color coded red or blue. Darker red and blue areas (shown blackened in the drawings) are provided on various portions of the segments to denote areas not to receive letter tiles during the course of the game, similar to blackened areas on a conventional crossword puzzle. In addition, however, diamonds and crosses are disposed along various aspects of the marginal and central segments which afford further opportunities for scoring. For example, the following list reflects one possible way that scoring can occur during the course of the game:

1. Two points for each unadorned tile played.
2. Six points for each diamond or cross covered.
3. Double word score when an adjoining pair of diamonds or crosses are covered and when the background is of different color. We recommend this be a pair of diamonds or crosses, not a diamond and cross.
4. Triple word score for an adjoining pair of crosses or diamonds when the background is the same color.
5. In all cases, total your score from rules 1 and 2 before doubling or tripling your score.
6. Double word score for placing a word that completes covering a segment. Note the central segment 8 contains nine 3×3 arrays which also benefits from this doubling.
7. Quadruple the word score for two adjoining segments covered when the backgrounds are of different color. One must actually place letter tiles in both segments that completes covering both segments in one play.
8. Double and then triple the word score when filling in two adjoining segments of the same color in one play.
9. When placing a word that also completes other words your receive full credit for each word. Count two points for each letter in all the words including any common letters which are counted as two points in the score for each word.
10. Diamonds and crosses are counted only when first covered, except in the case where a player removes and replaces wrong words on the board. They are then counted at full value in that second score.
11. It is advised to first put the letters for a word on the table, count your score and then place them on the board.
12. One may use an optional scoring system of also counting one additional point for each letter tile that adjoins the dark red or blue pattern. This would also apply to rule 9 where more than one word is completed. Decide on this option before starting the game.
13. Total your score from rules 1 thru 5 and 12 before doubling or tripling score in rules 6, 7 and 8.
14. Award a 30 point bonus for the player who places the last word, whether or not puzzle is completed.

More particularly, the game can be initialized and played as follows:

1. Shuffle and stack the sixteen marginal segments. Each player turns over one segment without reversing it in anyway. The first person to have a diamond in the upper left corner of the segment is the first player. This player places the marginal segments on the board as shown for the given pattern of the puzzle to be played by first placing the eight segments having darkened area as per the pattern desired to be played; thereafter, the remaining eight segments without darkened areas are placed without reorientation from the shuffled order.

2. The first player places a word, starting anywhere on the board, counts and announces his score. The second player is the score keeper. Play proceeds to the left.

3. Letter tiles have red and blue sides and must be placed with their red or blue side up to match the red or blue background.

4. If a player in his turn discovers that a wrong word or words have been placed on the board, that player may remove and replace them and count his score for the entire number of letters replaced. However, this can only be done in the place where he is making his current move.

5. Any player who places a word out of turn loses his next turn. However, if only two are playing, it is not mandatory for the second player to make two consecutive moves, if by so doing he would create a high scoring opportunity for his opponent.

6. Play continues until the puzzle is completed or if after two rounds, starting from the first player, no one can place a word on the board. The last layer to place a word receives a bonus of 30 points, scores are totaled, and high score wins. The 30 points bonus is counted whether or not the puzzle is completed.

Figure 3:
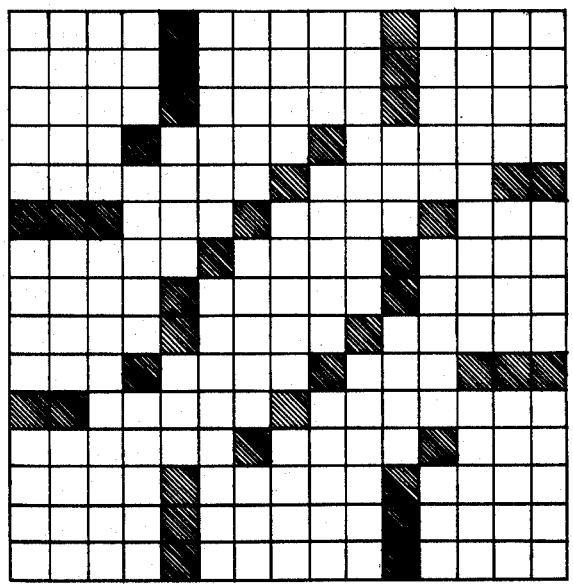
FIG. 3 shows an assembled game pattern for illustrative purposes.
Figure 4:
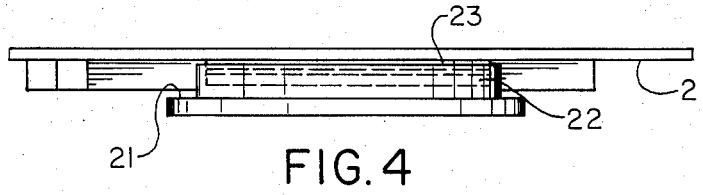
FIG. 4 is a side view of the board.
Figure 5:
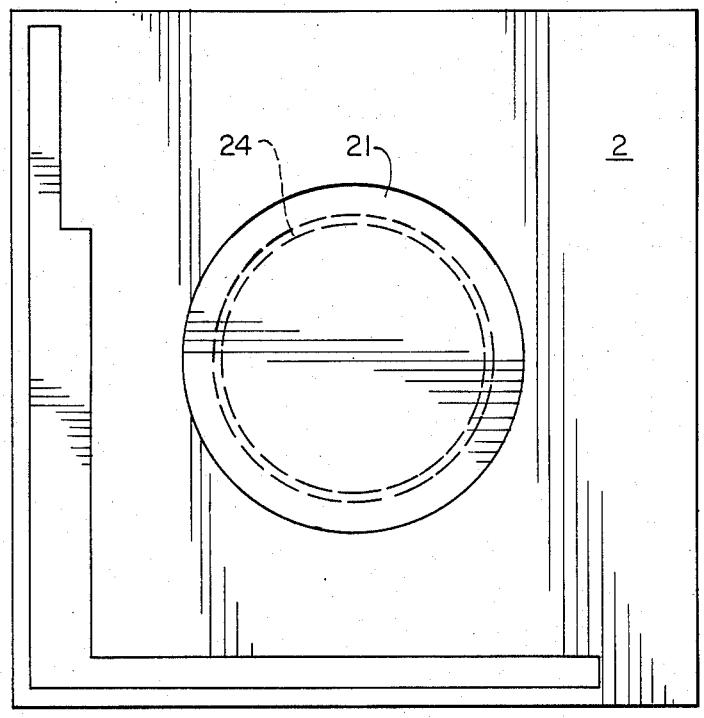
FIG. 5 is a bottom plan view.
Figure 7:
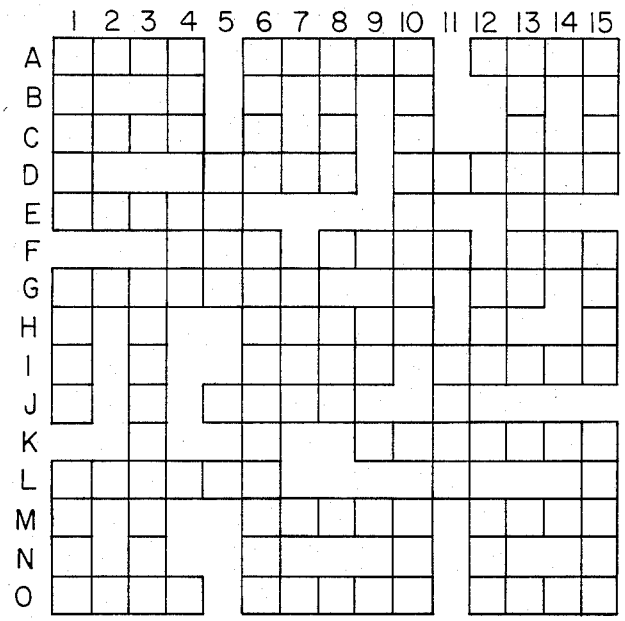
FIG. 7 is a view similar to FIG. 3 for receiving a patchcross puzzle of provided words.

FIG. 3 reflects one possible pattern when utilizing the instant game board apparatus, and the ensuing description shows a sample game being played on the FIG. 3 board including scoring.

PATCHWORK
PUZZLE SIX

| ACROSS | | DOWN | |
|---|---|---|---|
| A-1 | Paved Landing | A-1 | Deep Drink |
| A-6 | Glacial Slope | A-2 | To Such Time |
| A12 | Strike Breaker | A-3 | Worship |
| B-1 | Loosen | A-4 | _____ Kipper |
| B-6 | Vital Part | A-6 | Little Song |
| B12 | Great Lake | A-7 | Slow Gaita |
| C-1 | Particle | A-8 | Hideous Giant |
| C-6 | Scandinavian | A-9 | Talk Back |
| C12 | Girls Name | A-1O | Furtive/Devious |
| D-1 | Evergreen | A-12 | Intelligence |
| D-5 | Poker Stake | A-13 | Lookout Point |
| D10 | Reply | A-14 | Yorkshire River |
| E-1 | Extorta/Shears | A-15 | Shaggy Beast |
| E-9 | Heavens | D-5 | Holed In One |
| E-4 | Wager | D-11 | Nothing |
| F-8 | Muddy Up | E-4 | Dark Wood |
| F-13 | Bird Beak | E-9 | Scattered Seed |
| G-1 | Two Legged | F-8 | Sewers |
| G-7 | Mock | F-14 | Irish Gaelic |
| C-12 | Sport Fish | F-15 | Constrictors |
| H-1 | Soon | G-1 | Curse/Onus |
| H-6 | Arc Lamp | G-2 | Hep to |
| H-12 | Bone (Prefix) | G-3 | A.S.A.P. |
| I-1 | Prying/Curious | G-7 | Factory |
| I-6 | Disembark | G-12 | Tally |
| I-11 | Stringed Instruments | H-6 | Yukon Territory |
| J-1 | Within-Comb. Form | I-11 | Foliage/Page |
| J-5 | Swindles | J-5 | Hint/Signal |
| J-10 | Write | J-10 | Column |
| K-3 | Recur/Visit Often | K-4 | Mexican Indian |
| K-9 | Minute Aquatic | K-9 | Maryland City |
| L-1 | Soldered | K-13 | Convex Molding |
| L-8 | Ego | K-14 | Tropical Fruit |
| L-13 | Cistern | K-15 | Porticos |
| M-1 | Annealing Oven | L-1 | Society Is (Twice) |
| M-6 | Excellent | L-2 | Scold Harshly |
| M-12 | Infectious (Prefix) | L-8 | Joining/Layer |

-continued

| PATCHWORK PUZZLE SIX | | | |
|---|---|---|---|
| N-1 | Ceremony | M-7 | Half a bill |
| N-6 | Australian Bear | M-12 | Gullet |
| N-12 | Aquatic Plants | | |
| O-1 | Pianist Templeton | | |
| O-6 | Fudd | | |
| O-12 | Courts | | |

SCORING 3 blank = 6 points + 2 diamond = 6 + 6 = 12 = 18 points + triple for 2 diamond same color = 54 points
2 blank = 4 points + 2 diamond = 12 points = 16 points + triple = 48 points
2 blank = 4 points + 2 diamond = 12 points = 16 points + triple = 48 points
6 blank = 12 points + 3 crosses = 18 points = 30 points + triple = 90 points
3 blank = 6 points + 2 crosses = 12 points = 18 points + triple = 54 points
3 blank = 6 points + 2 diamond = 12 points = 18 points + triple = 54 points
3 blank = 6 points + 2 crosses = 12 points = 18 points + triple = 54 points
2 blank = 4 points + 2 diamond = 12 points = 18 points + triple = 54 points

| PLAYER | |
|---|---|
| 1. O-12 across Woods | 2 blank = 4 pts. + 2 diamond = 12 |
| 2. C-7 across Pawn | pts. = 16 pts. + double for 2 |
| 1. C-3 across Posthaste | adjoining diff. color = 32 pts. |
| 2. L-1 across Brazed | 2 blank = 4 pts. + 2 crosses = |
| 1. O-6 across Elmer | 12 pts. = 16 pts + double = 32 pts. |
| 2. A-10 down Sneaking | 6 blank = 12 pts. + P = 2 pts. + 2 |
| 1. A-12 down Sense | crosses = 12 pts. = 26 pts. |
| 2. A-14 down Aire | 3 blank = 6 pts. + B = 2 pts. = |
| 1. K-4 down Aztec | 8 pts. |
| 2. L-2 down Rail | 1 diamond and 1 cross = 12 pts. = |
| 1. H-6 down Klondike | 20 pts. |
| 2. N-6 across Koala | 3 blank = 6 pts. + 1 diamond and 1 |
| 1. A-6 across Quay | cross = 12 pts. = 18 pts. |
| 2. D-11 down Nil | 5 blank = 10 pts. + S and N = 4 |
| 1. E-1 across Fleeces | pts. = 14 pts. + 2 crosses = 12 |
| 2. A-1 down Quaff | pts. = 26 pts. |
| 1. E-4 down Ebony | 3 blank = 6 pts. + 1 diamond and 1 |
| 2. E-6 across Klieg | cross = 12 pts. = 18 pts. |
| 1. J-5 down Cue | 4 blank = 8 pts. + Scab = 8 pts. + |
| 2. F-13 across Neb | Erie = 8 pts. + Nora = 8 pts. = 28 |
| 1. A-4 down Yom | pts. + double for completing grid = |
| 2. A-2 down Until | 56 pts. |
| | 4 blank + 2 = 10 pts. + diamond = 6 pts. = 16 pts. This play was a mistake allowing the next play. |
| 3 blank + R = 8 pts. + Oast = 8 pts. + Rite = 8 pts. + Alec = 8 pts. = 32 pts. + double for completing grid = 64 pts | 4 blank = 8 pts. + L,D,l & E = 8 pts. = 16 pts. + double for completing grid = 32 pts. |
| 4 blank = 8 pts. + K = 2 pts. = 10 pts. + Dol. + 6 pts. + 16 pts. + double for completing grid = 32 pts. | 1 blank + A + 4 pts. + 2 crosses = 12 pts = 16 pts. |
| 3 blank + 6 pts. + Answer = 12 pts. = 18 pts + double for completing grid = 36 pts. | 6 blank = 12 pts. + E = 2 pts = 14 pts. |
| | 3 blank + 6 pts. + O and F + 4 pts. = 10 |
| | 3 blank = 6 pts. + E and O + 4 pts. + 10 pts. + double for completing grid = 20 pts |

3 blank = 6 pts. + K and C = 4 pts + 10 pts. + double for completing grid = 20 pts
2 blank = 4 pts. + E = 2 pts. = 6 pts. + double for completing grid = 12 pts.
2 blank + N = 6 pts. double = 12 pts.
2 blank + Y = 6 pts.
3 blank + U and L = 10 pts. + Undo = 8 pts. + Atom + 8 pts. + Fir = 6 pts. = 32 pts. + double and then triple for completing 2 grids of same color in one play = 192 pts.

As can be seen, a dynamic and competitive game is afforded by utilizing the suggested scoring procedures. It should be equally clear that this game lends itself also to a single player playing a crossword puzzle in a solitary fashion, thus evidencing a high degree of flexibility in this game.

The FIG. 3 can also be utilized for a game in which the answers are provided and required to be placed within the appropriate areas on the board without clues having been given. The following illustrates this concept.

| PATCHCROSS PUZZLE ONE | |
|---|---|
| 2 LETTERS | 5 LETTERS |
| Ax | Dingo |
| Be | Honey |
| 3 LETTERS | Orang |
| Bee | Otter |
| Eft | Pumas |
| Ewe | Shark |
| Men | Shrew |
| Rat | Tapir |
| Wok | Zebra |
| Yak | 6 LETTERS |
| 4 LETTERS | Alevin |
| Anat | Impala |
| Auks | 7 LETTERS |
| Boar | Manatee |
| Caws | Habitat |
| Crow | 8 LETTERS |
| Colt | Gorillas |
| Deer | Piranhas |
| Emus | 9 LETTERS |
| Ibex | Redbreast |
| Newt | |
| Orca | |
| Rube | |
| Saki | |
| Sora | |
| Titi | |
| Tuna | |
| Wasp | |
| Wren | |
| Zebu | |

In use and operation, the game board and associated equipment when purchased will include a plurality of suggested patterns for orienting the marginal and central segments, along with proposed games that are to be played with various configurations. It should be clear that the central segment 8 can be manipulated and oriented in any of eight configurations, while the marginal segments are each capable of orientation in eight possible ways and are capable of being placed in any of the sixteen marginal places associated therewith creating an exceedingly large number of possible board configurations. It is contemplated that purchasers of the game will be subscribers to a periodical which would provide further games and solutions. Alternatively, one can create one's own crossword puzzle game given the segments as shown for the purposes of generating a crossword puzzle.

Having thus described the preferred embodiment of the invention, it should be understood that numerous structural modifications and adaptations may be resorted to without departing from the spirit of the invention.

What is claimed is:

1. An educational word game comprising of combination, a game board having an upper surface which supports a plurality of removeable marginal game board segments and a removable, larger central game board segment, all said segments defining a playing surface and provided with coding correlative of scoring opportunities by placing game tiles thereon, said segments are substantially square in shape and said coding is embodied as diverse colors and symmetrical geometrical designs such that reorientation of any or all said segments will afford players a different game since said coding is neutral to reorientation due to the symmetry and colors, each said marginal segment defined by an N×N matrix with an equal member of rows and columns upon which said tiles are placed, said central segment defined by a YN×YN matrix with an equal number of rows and columns upon which said tiles are placed, where Y is a whole number integer greater than or equal to one, said marginal segments completely circumscribe said central segment such that any row or column of marginal segments has YN+2N marginal segments.

2. The educational word game of claim 1 wherein said upper surface is circumscribed by a frame means of substantially square configuration having two pairs of spaced parallel horizontal and vertical legs defining a rectangular frame, and first indicia means disposed on said frame whereby initial deployment of said segments can be correlated with a pre-existing pattern through said first indicia means.

3. The educational word game of claim 2 wherein said game board includes a plurality of pockets circumscribing at least a portion of said frame within which said tiles are stored.

4. The educational word game of claim 3 wherein second indicia means are provided adjacent said pockets adapted to correlate the letters of the alphabet from said tiles to associated pockets whereby each said pocket bears tiles having letters of the alphabet corresponding to said second indicia means disposed on said game board.

5. The educational word game of claim 4 wherein adjacent segments on said board are separated one from the other by means of a plurality of lips extending up from said upper surface thereby segregating said segments.

6. The educational word game of claim 5 including an educative pattern adapted to be used in conjunction with said segments, said segments oriented in accordance with said pattern, serving as a template.

7. The educational word game of claim 6 wherein said coding correlates to mathematical bonus scoring opportunities whereby placement of said tiles on said geometrical designs and different colors provide scoring bonus opportunities.

8. The educational word game of claim 7 wherein said game board structure is formed from a single moldable material including said upwardly extending lips, said pockets and said frame legs.

9. The educational word game of claim 8 wherein said coding is disposed on both opposite faces of all said segments having two colors, darker areas on said segments indicative of areas not to be provided with tiles, and a plurality of diamonds and crosses disposed on lighter areas to provide areas of greater scoring potential.

10. An educational word game comprising of combination, a game board having an upper surface which supports a plurality of removable marginal game board segments and a removable, larger central game board segment, all said segments defining a playing surface and provided with coding correlative of scoring opportunities by placing game tiles thereon, said segments are substantially square in shape and said coding is embodied as diverse colors and symmetrical geometrical designs such that reorientation of any or all said segments will afford players a different game since said coding is neutral to reorientation due to the symmetry and colors, each said marginal segment defined by an N×N matrix with an equal member of rows and columns upon which said tiles are placed, said central segment defined by 3N×3N matrix with an equal number of rows and columns upon which said tiles are placed, said marginal segments completely circumscribe said central segment such that any row or column of marginal segments has 5 marginal segments.

11. The educational word game of claim 10 wherein said upper surface is circumscribed by a frame means of substantially square configuration having two pairs of spaced parallel horizontal and vertical legs defining a rectangular frame, and first indicia means disposed on said frame whereby initial deployment by said segments can be correlated with a pre-existing format through said first indicia means.

12. The educational word game of claim 11 wherein said game board includes a plurality of pockets circumscribing at least a portion of said frame within which said tiles are stored.

13. The educational word game of claim 12 wherein second indicia means are provided adjacent said pockets adapted to correlate the letters of the alphabet from said tiles to associated pockets whereby each said pocket bears tiles having letters of the alphabet corresponding to said second indicia means disposed on said game board.

14. The educational word game of claim 13 wherein adjacent segments on said board are separated one from the other by means of a plurality of lips extending up from said upper surface thereby segregating said segments.

15. The educational word game of claim 14 including an educative pattern adapted to be used in conjunction with said segments, said segments oriented in accordance with said pattern, serving as a template.

16. the educational word game of claim 15 wherein said coding correlates to mathematical bonus scoring opportunities whereby placement of said tiles on said geometrical designs and different colors provide scoring bonus opportunities.

17. The educational word game of claim 16 wherein said game board structure is formed from a single moldable material including said upwardly extending lips, said pockets and said frame legs.

18. The educational word game of claim 17 wherein said coding is disposed on both opposite faces of all said segments having two colors, darker areas on said segments indicative of areas not to be provided with tiles, and a plurality of diamonds and crosses disposed on lighter areas to provide areas of greater scoring potential.

19. An educational word game comprising of combination, a game board having an upper surface which supports a plurality of removable marginal game board segments and a removable, larger central game board segment, all said segments defining a playing surface and provided with coding correlative of scoring opportunities by placing game tiles thereon, said segments are substantially square in shape and said coding is embodied as diverse colors and symmetrical geometrical designs such that reorientation of any or all said segments will afford players a different game since said coding is neutral to reorientation due to the symmetry and colors, each said marginal segment defined by a $3\times3$ matrix with an equal member of rows and columns upon which said tiles are placed, said central segment defined by $9\times9$ matrix with an equal number of rows and columns upon which said tiles are placed, said marginal segments completely circumscribe said central segment such that any row or column of marginal segments has 5 marginal segments.

20. The educational word game of claim 19 wherein said upper surface is circumscribed by a frame means of substantially square configuration having two pairs of spaced parallel horizontal and vertical legs defining a square configuration, and first indicia means disposed on said frame whereby initial deployment of said segments can be correlated with a pre-existing pattern through said first indicia means, wherein said game board includes a plurality of pockets circumscribing at least a portion of said frame within which said tiles are stored, wherein second indicia means are provided adjacent said pockets adapted to correlate the letters of the alphabet from said tiles to associated pockets whereby each said pocket bears tiles having letters of the alphabet corresponding to said second indicia means disposed on said game board, wherein adjacent segments on said board are separated one from the other by means of a plurality of lips extending up from said upper surface thereby segregating said segments, an educative pattern adapted to be used in conjunction with said segments, said segments oriented in accordance with said pattern, serving as a template, wherein said coding correlates to mathematical bonus scoring opportunities whereby placement of said tiles on said geometrical designs and different colors provide scoring bonus opportunities, wherein said game board structure is formed from a single moldable material including said upwardly extending lips, said pockets and said frame legs, and wherein coding is disposed on both opposite faces of all said segments having two colors, darker areas on said segments indicative of areas not to be provided with tiles, and a plurality of diamonds and crosses disposed on lighter areas to provide areas of greater scoring potential.

* * * * *